US011158967B2

(12) United States Patent
Sugaya et al.

(10) Patent No.: US 11,158,967 B2
(45) Date of Patent: Oct. 26, 2021

(54) BOARD-TO-BOARD ELECTRICAL CONNECTOR WITH LOCK DISENGAGEABLE BY AN OPERATION PORTION

(71) Applicant: FUJIKURA LTD., Tokyo (JP)

(72) Inventors: Soichi Sugaya, Tokyo (JP); Kazunori Takei, Tokyo (JP); Yasuyuki Akiyama, Tokyo (JP); Toshihiko Hirai, Tokyo (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 16/756,731

(22) PCT Filed: Jul. 31, 2018

(86) PCT No.: PCT/JP2018/028560
§ 371 (c)(1),
(2) Date: Apr. 16, 2020

(87) PCT Pub. No.: WO2019/077840
PCT Pub. Date: Apr. 25, 2019

(65) Prior Publication Data

US 2021/0194162 A1 Jun. 24, 2021

(30) Foreign Application Priority Data

Oct. 20, 2017 (JP) ..... JP2017-203722

(51) Int. Cl.
*H01R 12/71* (2011.01)
*H01R 13/627* (2006.01)
*H01R 12/70* (2011.01)

(52) U.S. Cl.
CPC ..... *H01R 12/716* (2013.01); *H01R 13/6271* (2013.01); *H01R 12/70* (2013.01);
(Continued)

(58) Field of Classification Search
CPC .. H01R 12/716; H01R 13/6271; H01R 12/70; H01R 12/71; H01R 12/712; H01R 13/627
(Continued)

(56) References Cited

FOREIGN PATENT DOCUMENTS

CN 104901069 A * 9/2015
CN 104901069 A 9/2015
(Continued)

OTHER PUBLICATIONS

International Search Report and Written Opinion for related PCT App No. PCT/JP2018/028560 dated Nov. 6, 2018, 6 pgs. (partial translation).

*Primary Examiner* — Abdullah A Riyami
*Assistant Examiner* — Justin M Kratt
(74) *Attorney, Agent, or Firm* — Procopio, Cory, Hargreaves & Savitch LLP

(57) ABSTRACT

An electrical connector that maintains connection stability and enables easy removal so as not to cause any damage during removal with a reduced size and reduced profile. At the time of removal of two connectors, when an operation portion of a locking member of the receptacle connector is pushed inward in the longitudinal pitch direction, a locking piece pushes and spreads an engagement portion of an engagement member outward widthwise, and simultaneously a protrusion portion is also moved outward widthwise, whereby the aforementioned lapped state is released and unlocked, enabling removal. When the operation portion is released, the locking piece is pushed inward widthwise by resiliency of the engagement portion, and the protrusion portion is returned to the initial position corresponding to the position in which the protrusion portion is lapped with a step portion when viewed from the fitting direction at the time of completion of fitting.

11 Claims, 15 Drawing Sheets

(52) U.S. Cl.
CPC ..... *H01R 12/71* (2013.01); *H01R 12/712* (2013.01); *H01R 13/627* (2013.01)

(58) Field of Classification Search
USPC ..... 439/74, 660
See application file for complete search history.

(56) References Cited

FOREIGN PATENT DOCUMENTS

| | | | | | |
|---|---|---|---|---|---|
| CN | 106654664 | A | | 5/2017 | |
| CN | 108258468 | A | * | 7/2018 | ..... H01R 12/73 |
| CN | 108258468 | A | | 7/2018 | |
| JP | 2007109522 | A | | 4/2007 | |
| JP | 2009266629 | A | | 11/2009 | |
| JP | 2010198996 | A | | 9/2010 | |
| JP | 2014093181 | A | | 5/2014 | |
| JP | 5688063 | B2 | | 3/2015 | |
| JP | 2016110706 | A | | 6/2016 | |
| JP | 6080786 | B2 | | 2/2017 | |

* cited by examiner

BOARD-TO-BOARD ELECTRICAL CONNECTOR WITH LOCK DISENGAGEABLE BY AN OPERATION PORTION

CROSS-REFERENCE TO RELATED APPLICATIONS

This application is a U.S. National Stage entry of PCT Application No: PCT/JP2018/028560 filed on Jul. 31, 2018, which claims priority to Japanese Patent Application No. 2017-203722 filed Oct. 20, 2017, the contents of which are incorporated herein by reference.

TECHNICAL FIELD

The present invention relates to an electrical connector that connects substrates used in a communication device, an electrical device, or an electronic device, e.g., a portable terminal or an audio device, and more particularly to a simple and reliable structure for attaching and detaching a plug connector and a receptacle connector.

BACKGROUND ART

In general, an electrical connector that connects a substrate and a substrate includes a plug connector and a receptacle connector. A connector is mounted on each substrate, and the connectors are fit to connect the substrates. The plug connector at least includes a plug contact and a block, and the receptacle connector at least includes a receptacle contact and a housing. Each connector in some cases uses a fixture as necessary.

As described in Patent Literatures 1 and 2 below, as an electrical connector that connects a substrate and a substrate, the applicant has proposed those including a locking mechanism at both ends in a longitudinal pitch direction.

CITATION LIST

Patent Literature

Patent Literature 1: JP2009-266629A
Patent Literature 2: JP2010-198996A

SUMMARY OF INVENTION

Technical Problem

In recent years, communication devices, electrical devices, electronic devices and the like have been reduced in size, and connectors have also been reduced in size. Meanwhile, maintenance of connection stability and stable fitting are demanded with a reduction in size (particularly, in widthwise pitch direction) and a reduction in profile. There has been a demand to provide a locking mechanism and to increase holding force in the interest of connection stability and stable fitting.

However, on the other hand, in the case of the locking mechanism of Patent Literatures 1 and 2 described above, an increase in holding force of the locking mechanism results in such problems that the connectors cannot be removed from each other or be damaged when removed by an excessive force.

The present invention has been made in view of such conventional problems, and provides an electrical connector with a structure that maintains connection stability and enables easy removal so as not to cause any damage during removal while the size is reduced (particularly, in a widthwise pitch direction) and the profile is reduced.

Solution to Problem

The present invention has been made to achieve the aforementioned object, and the gist and the configuration of the electrical connector structure of the present invention are as follows:

(1) An electrical connector including a plug connector and a receptacle connector configured to be attachable and detachable with respect to each other, in which the plug connector includes a required number of plug contacts each including a contact portion that contacts a receptacle contact and a connection portion mounted on a substrate, and a block on which the plug contacts are held and arranged, the receptacle connector includes a required number of receptacle contacts each including a contact portion that contacts the plug contact and a connection portion mounted on a substrate, and a housing on which the receptacle contacts are held and arranged, a first fixture at least including a step portion and a connection portion mounted on a substrate is disposed at both ends of the plug connector in a longitudinal pitch direction, an engagement member having a substantially U shape including a protrusion portion on both free end sides is disposed at both ends of the receptacle connector in the longitudinal pitch direction, and includes an engagement portion that is bent on both sides in a widthwise direction and has resiliency, at a substantially intermediate portion of the engagement member, a locking member including a locking piece extending in a substantially L shape on both sides in the widthwise direction from an operation portion is disposed at both ends of the receptacle connector in the longitudinal pitch direction, and the locking pieces facing in the widthwise direction are inclined to have a narrower distance on an end side, in a process of fitting the plug connector and the receptacle connector, the step portion enters an inner side between the protrusion portions, the engagement portion is spread outward in the widthwise direction by resiliency, and, at a time of completion of fitting, the step portion and the protrusion portion are brought into a lapped state when viewed from a fitting direction, at a time of removal, when the operation portion is pushed inward in the longitudinal pitch direction, the locking piece pushes and spreads the engagement portion outward in the widthwise direction, and simultaneously the protrusion portion is also spread outward in the widthwise direction, and the lapped state is released, enabling removal, and when the operation portion is released, the locking piece is pushed inward in the widthwise direction at least by resiliency of the engagement portion, and the protrusion portion is returned to an initial position corresponding to a position in which the protrusion portion is lapped with the step portion when viewed from the fitting direction at the time of fitting.

(2) The electrical connector according to (1), in which the protrusion portion includes a guide portion on an insertion side of the plug connector.

(3) The electrical connector according to (1) or (2), in which an end surface of the locking member is pressed against the housing to suppress movement of the locking member.

(4) The electrical connector according to (1), (2), or (3), in which a stopper piece is formed at a substantially middle portion of the engagement member to suppress movement of the locking member, and the locking member includes a locking hole where the stopper piece enters.

(5) The electrical connector according to (1), (2), (3), or (4), in which in order for the protrusion portion to return to the initial position when the operation portion is released, the locking member includes a protrusion piece that protrudes in a contact attachment direction, and a coil spring that engages the protrusion piece is disposed.

(6) The electrical connector according to (5), in which in order for the protrusion portion to be forcibly returned to the initial position by a jig when the operation portion is released, a hole is formed in the operation portion of the locking member.

(7) The electrical connector according to any one of (1) to (6), in which the block includes a first fitting port where a fitting portion of the receptacle connector enters, and the housing includes a fitting portion that enters the first fitting port and a second fitting port where the plug connector enters, the plug contact is held on the block by integral molding and includes a recess where the receptacle contact enters, the receptacle contact includes a resilient portion that is curved at least once or more between the contact portion and the connection portion, the contact portion, the resilient portion, and the connection portion are disposed in an order of the contact portion, the resilient portion, and the connection portion, the receptacle contact further includes a fixation portion that is a part of the resilient portion on the connection portion side, the fixation portion being for holding on the housing, and an inclined portion that is inclined is formed between the resilient portion and the contact portion, the housing includes an insertion hole into which the receptacle contact is inserted, and the insertion hole is formed on an inclined portion having a curved shape, and the plug contact is clamped between the contact portion and the resilient portion of the receptacle contact to obtain stable connection.

(8) The electrical connector according to (7), in which the receptacle contact includes a first chamfered portion on the contact portion and a second chamfered portion on a part of the resilient portion on the fixation portion side, and the first chamfered portion of the receptacle contact engages the recess of the plug contact to provide click feeling as well as positioning and contact.

(9) The electrical connector according to any one of (1) to (8), in which the receptacle connector further includes, at both ends in the longitudinal pitch direction, a second fixture that contacts the first fixture when the plug connector fits to the receptacle connector.

(10) The electrical connector according to (9), in which the engagement member includes an extension wall that extends in the widthwise direction and includes the protrusion portion at a free end, and the housing includes a brim portion that covers the extension wall on an insertion side of the plug connector.

(11) The electrical connector according to (10), in which the second fixture includes a cover wall that covers the brim portion.

Advantageous Effects of Invention

With the electrical connector of the present invention, it is possible to enable easy removal and to obtain stable connection without occurrence of damage during removal even with an increase in holding force while the size is reduced (particularly, in a widthwise pitch direction) and the profile is reduced.

DESCRIPTION OF EMBODIMENTS

Figure 1A:
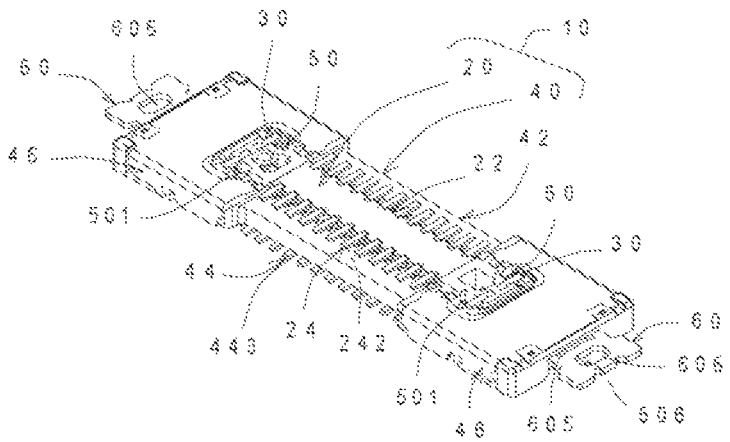
FIG. 1(A) is a perspective view of a state in which a plug connector and a receptacle connector of an electrical connector of an embodiment of the present invention are fit viewed from a plug connector direction.
Figure 1B:
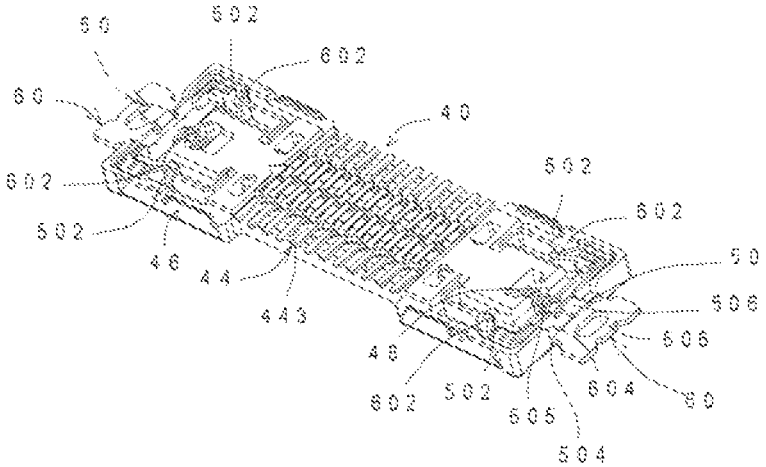
FIG. 1(B) is a perspective view of a state in which the plug connector and the receptacle connector are fit viewed from a receptacle connector direction (connection direction).
Figure 1C:
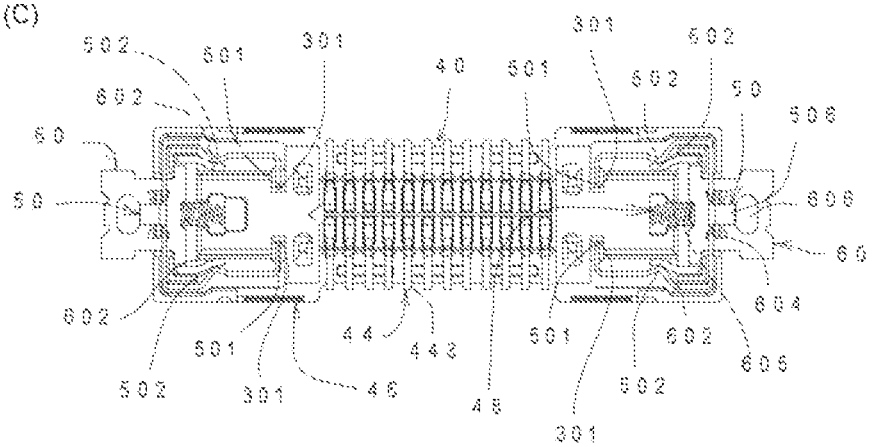
FIG. 1(C) is a plan view of a state in which the plug connector and the receptacle connector are fit viewed from the receptacle connector direction (connection direction).

As illustrated in FIG. 1, an electrical connector 10 of an embodiment of the present invention includes a plug connector 20 and a receptacle connector 40 that can be attached and detached with respect to each other. The plug connector 20 includes a plug contact 24 including a contact portion 241 that contacts a receptacle contact 44 and a connection portion 242 mounted on a substrate, and a block 22 on which the plug contact 24 is held and arranged. The receptacle connector 40 includes the receptacle contact 44 including a contact portion 441 that contacts the plug contact 24 and a connection portion 443 mounted on a substrate, and a housing 42 on which the receptacle contact 44 is held and arranged.

At both ends of the plug connector 20 in a longitudinal pitch direction, a first fixture 30 at least including a step portion 303 and a connection portion 305 mounted on a substrate is disposed.

At both ends of the receptacle connector 40 in a longitudinal pitch direction, an engagement member 50 having a substantially U shape is disposed. The engagement member 50 includes a protrusion portion 501 on both free end sides thereof. At a substantially intermediate portion of the engagement member 50, an engagement portion 502 that has resiliency and is bent on both sides in a widthwise direction is formed.

At both ends of the receptacle connector 40 in the longitudinal pitch direction, a locking member 60 is disposed. The locking member 60 includes an operation portion 601 and a locking piece 602 extending in a substantially L shape from the operation portion 601 on both sides in the widthwise direction. The locking pieces 602 facing in the widthwise direction are inclined to have a narrower distance on an end side.

At the initial stage of fitting between the plug connector 20 and the receptacle connector 40, the first fixture 30 enters between the protrusion portions 501, the engagement portions 502 are resiliently deformed and spread outward in the widthwise direction, and, at the time of completion of fitting, the step portions 303 of the first fixture 30 and the protrusion portions 501 are brought into a lapped (overlapped) state when viewed from a fitting direction. At the time of removal, when the operation portions 601 are pushed inward in the longitudinal pitch direction (toward the other end in the longitudinal direction), the locking pieces 602 push and spread the engagement portions 502 outward in the widthwise direction, and simultaneously the protrusion portions 501 are also moved outward in the widthwise direction. Thus, the aforementioned overlapped state is released, enabling removal.

When the operation portions 601 are released, the locking pieces 602 are pushed inward in the widthwise direction at least by the resiliency of the engagement portions 502, and the protrusion portions 501 are returned to the initial position corresponding to the position in which the protrusion portions 501 are lapped (overlapped) with the step portions 303 when viewed from the fitting direction at the time of completion of fitting.

That is, at the initial stage of fitting between the two connectors 20 and 40, when the first fixture 30 of the plug connector 20 enters between the protrusion portions 501 of the engagement members 50 of the receptacle connector 40, the engagement portions 502 of the engagement members 50 are spread outward in the widthwise direction by resiliency, and, at the time of completion of fitting, the step portions 303 of the first fixture 30 and the protrusion portions 501 of the engagement member 50 are brought into an overlapped and locked state when viewed from the fitting direction.

Meanwhile, at the time of removal, when the operation portions 601 of the locking members 60 of the receptacle connector 40 are pushed inward in the longitudinal pitch direction, the locking pieces 602 of the locking members 60 push and spread the engagement portions 502 of the engagement members 50 outward in the widthwise direction, and simultaneously the protrusion portions 501 are also moved outward in the widthwise direction. Thus, the aforementioned lapped state is released and unlocked, enabling removal.

Then, when the operation portions 601 are again released, the locking pieces 602 are pushed inward in the widthwise direction at least by resiliency of the engagement portions 502, and the protrusion portions 501 are returned to the initial position corresponding to the position in which the protrusion portions 501 are lapped with the step portions 303 when viewed from the fitting direction at the time of completion of fitting. Thus, the two connectors 20 and 40 can be attached and detached with respect to each other.

A more detailed description is given below. The electrical connector 10 of the present embodiment includes the plug connector 20 and the receptacle connector 40. The plug connector 20 at least includes a plurality of plug contacts 24, the block 22, and the first fixtures 30. The receptacle connector 40 at least includes a plurality of receptacle contacts 44, the housing 42, the engagement members 50, and the locking members 60. Furthermore, in the present embodiment, the receptacle connector 40 includes second fixtures 46.

The electrical connector 10 of the present embodiment is a substrate-to-substrate connector, i.e. a board-to-board (B to B) connector in which the plug connector 20 is mounted on one substrate, the receptacle connector 40 is mounted on the other substrate, and the plug connector 20 and the receptacle connector 40 are coupled such that the two substrates are electrically connected. The substrate includes a hard substrate, an FPC (flexible printed circuit), and the like. Here, a hard substrate is described by way of example. On the substrate on which the plug connector 20 is mounted, at least a land connected to the connection portions 242 of the plug contacts 24 and a pattern linked to the circuit from the land are formed. On the substrate on which the receptacle connector 40 is mounted, a land connected to the connection portions 443 of the receptacle connectors 40 and a pattern linked to the circuit from the land are formed.

Figure 7A:
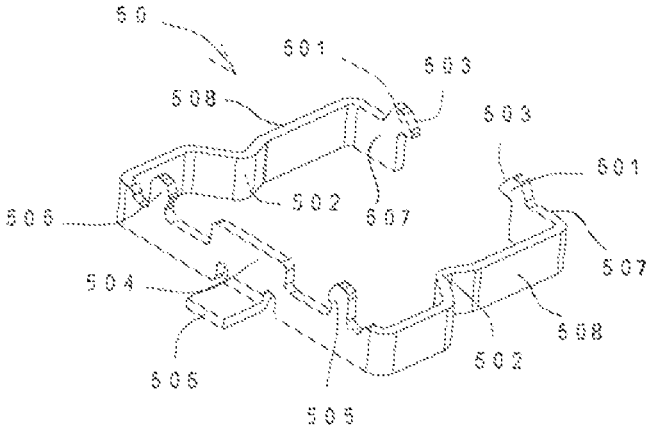
FIG. 7(A) is a perspective view of an engagement member viewed from a fitting direction side.
Figure 7B:
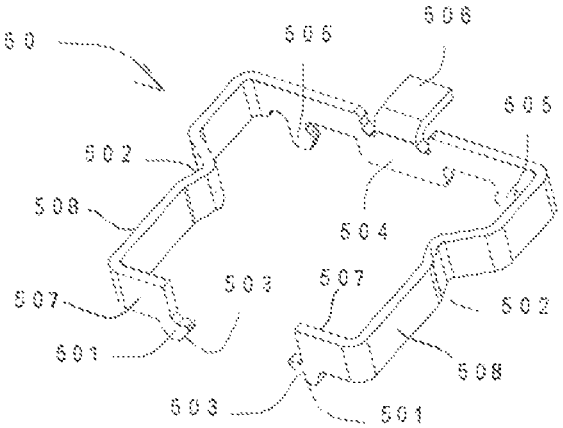
FIG. 7(B) is a perspective view of the engagement member viewed from the side opposite to the fitting direction (side for connection to a substrate).

First of all, the receptacle connector 40 is described. First, the engagement member 50 is described particularly with reference to FIGS. 2, 3 and 7. The engagement member 50 is made of metal and is manufactured by pressing of a publicly known technique. Examples of the material of the engagement member 50, which requires springiness, conductivity, and the like, can include beryllium copper, phosphor bronze, Corson alloy, and the like.

The engagement member 50 has a substantially U shape, and the protrusion portion 501 protruding in the widthwise direction is formed on both free end sides. The protrusion portion 501 is to engage (contact) the step portion 303 of the first fixture 30 of the plug connector 20 so as to prevent removal when the two connectors 20 and 40 are to be removed by force. The size and the shape of the protrusion portion 501 are properly designed in consideration of the role, the strength, the holding force, the workability, and the like.

It is desirable that a guide portion 503 be formed on a surface of the protrusion portion 501 on an insertion side of the plug connector 20. The guide portion 503 is a portion for guiding entry of the step portion 303 of the first fixture 30 of the plug connector 20 to an inner side of the engagement member 50 when the two connectors 20 and 40 are fit.

The size and the shape of the guide portion 503 are properly designed in consideration of the guidability, the strength, the holding force, the workability, and the like. The shape may be, for example, chamfered, rounded, or inclined.

A substantially intermediate portion of the engagement member 50 includes, on both sides in the widthwise direction, the engagement portion 502 that is bent in a substantially V shape and has resiliency. In a process of fitting the two connectors 20 and 40, the engagement portion 502 is a portion that spreads the protrusion portion 501 outward in the widthwise direction by resiliency such that the step portion 303 of the first fixture 30 of the plug connector 20 passes the guide portion 503 and enters an inner side of the engagement member 50, i.e., between the opposite protrusion portions 501. The engagement portion 502 restores the protrusion portion 501 inward in the widthwise direction by resiliency at the time of completion of fitting, and thus the step portion 303 and the protrusion portion 501 of the engagement member 50 are brought into a lapped (engaged) state when viewed from the fitting direction. At the time of removal of the two connectors 20 and 40, when the operation portion 601 of the locking member 60 of the receptacle connector 40 is pushed inward in the longitudinal pitch direction (toward the other end in the longitudinal direction), the engagement portion 502 pushes and spreads the engagement member 50 outward in the widthwise direction and simultaneously the protrusion portion 501 is also allowed to spread outward in the widthwise direction. Thus, the state in which the step portion 303 and the protrusion portion 501 of the engagement member 50 are lapped (engaged) when viewed from the fitting direction is released. The size and the shape of the engagement portion 502 are properly designed in consideration of the resiliency, the strength, the holding force, the workability, and the like.

A coupling wall 508 is extended from the engagement portion 502 along the longitudinal direction. An extension wall 507 is formed from an end of the coupling wall 508 on the side opposite from the engagement portion 502, along an inner side in the widthwise direction. The protrusion portion 501 is formed at an end of the extension wall 507 on the side opposite from the coupling wall 508 and at an upper portion (side on which the plug connector 20 is inserted).

At a substantially middle portion on the rear side (side opposite to the protrusion portion 501) of the engagement member 50, a stopper piece 504 is formed to suppress movement of the locking member 60. The stopper piece 504 is to restrict the movement of the locking member 60 at the time of fitting and removal of the two connectors 20 and 40 with respect to each other. The size and the shape of the stopper piece 504 are properly designed in consideration of the role, the strength, the workability, and the like.

The engagement member 50 includes, on both sides of the stopper piece 504, a fixation portion 505 protruding in the same direction as the stopper piece 504 (upward). The fixation portion 505 is a portion fixed to the housing 42 and is fixed to the housing 42 by press-fitting, a catch (lance), welding, or the like. In the present example, it is fixed by press-fitting. The shape and the size of the fixation portion 505 are properly designed in consideration of the holding force, the strength, the workability, and the like.

At a substantially middle portion on the rear side of the engagement member 50 (lower end of the stopper piece 504), a connection portion 506 is formed. The connection portion 506 is a portion mounted on the substrate and, in the present example, a surface mount (SMT)-type connection portion 506 is indicated. The connection portion 506 may be of a DIP type or press-in type as long as it can be mounted on the substrate. The connection portion 506 is designed in consideration of the substrate occupation area, the mounting density, and the like.

Figure 2A:
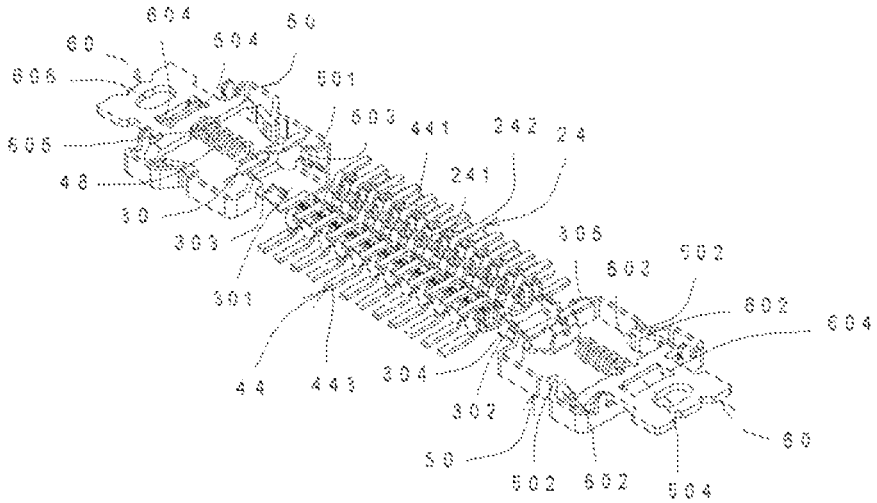
FIG. 2(A) is a perspective view of a locked state viewed from a plug connector insertion direction in a state in which an insulator and a second fixture on a receptacle connector side are omitted.
Figure 2B:
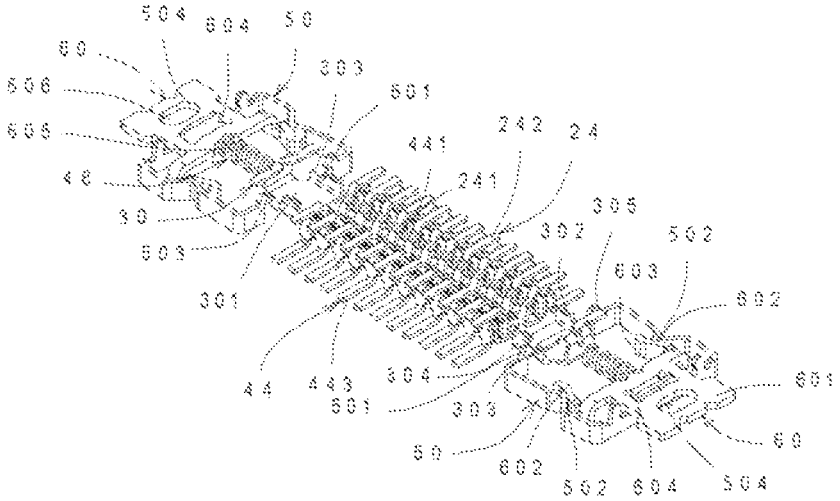
FIG. 2(B) is a perspective view of an unlocked state viewed from the plug connector insertion direction in a state in which the insulator and the second fixture on the receptacle connector side are omitted.
Figure 3A:
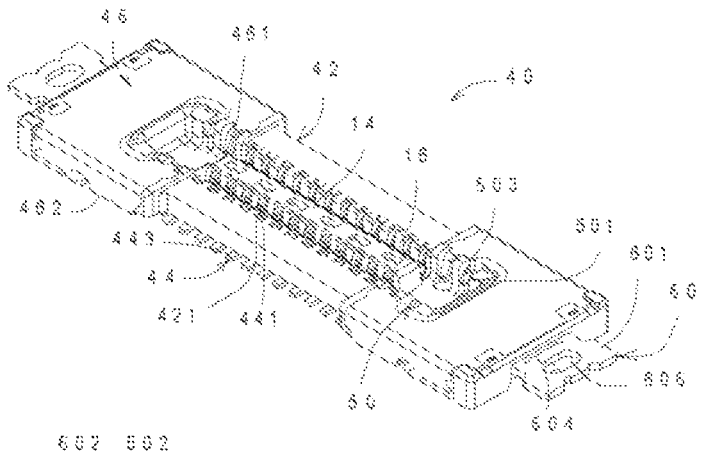
FIG. 3(A) is a perspective view of a receptacle connector viewed from a fitting direction.
Figure 3B:
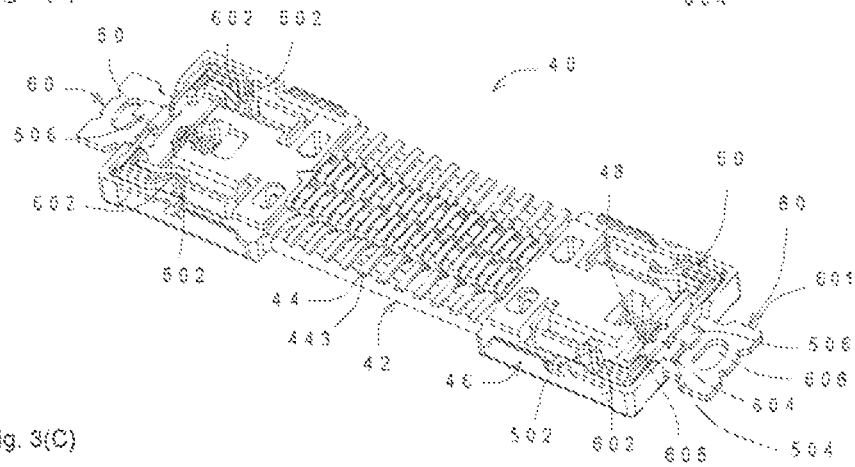
FIG. 3(B) is a perspective view of the receptacle connector viewed from the side opposite to the fitting direction (side for connection to a substrate).
Figure 3C:
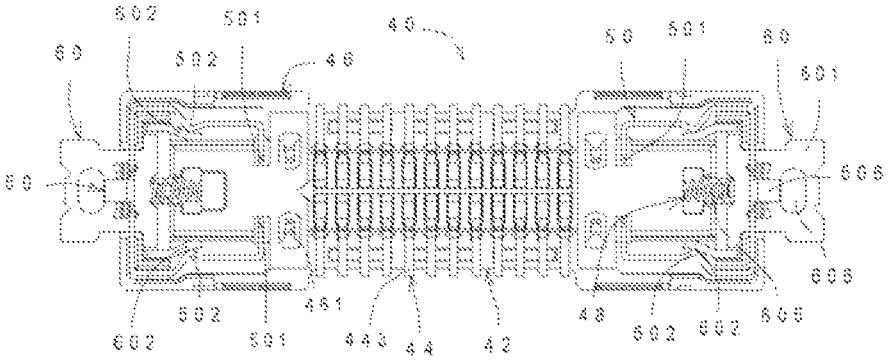
FIG. 3(C) is a plan view of the receptacle connector viewed from the side opposite to the fitting direction (side for connection to a substrate).
Figure 4A:
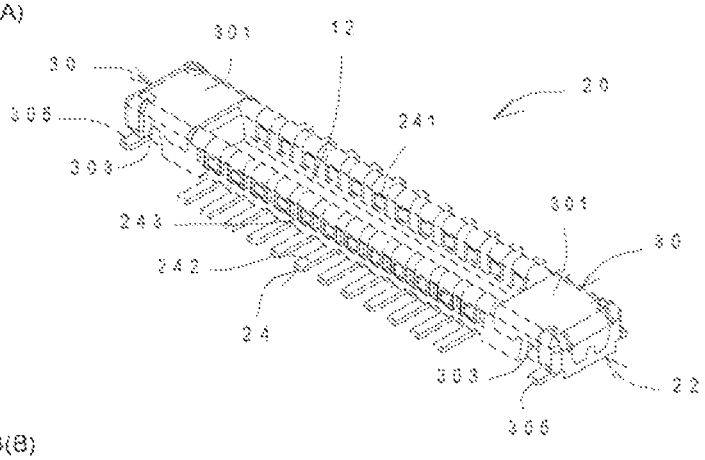
FIG. 4(A) is a perspective view of a plug connector viewed from a fitting direction.
Figure 4B:
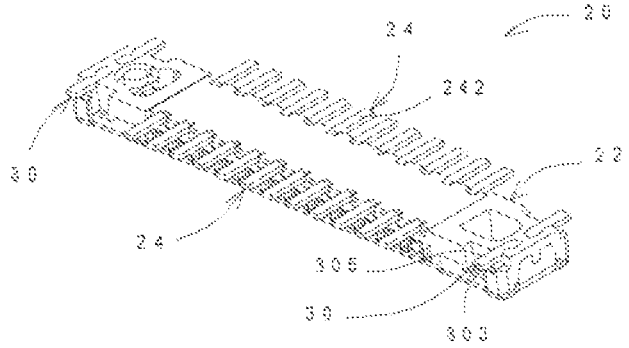
FIG. 4(B) is a perspective view of the plug connector viewed from the side opposite to the fitting direction (side for connection to a substrate).
Figure 4C:
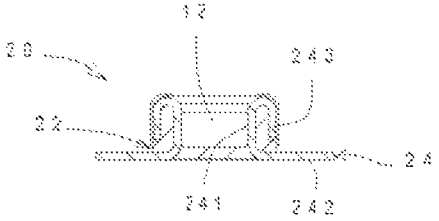
FIG. 4(C) is a longitudinal cross-sectional view of the plug connector cut at a certain contact portion.
Figure 4D:
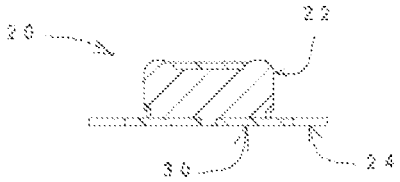
FIG. 4(D) is a cross-sectional view of the plug connector cut at a fixture portion.
Figure 8A:
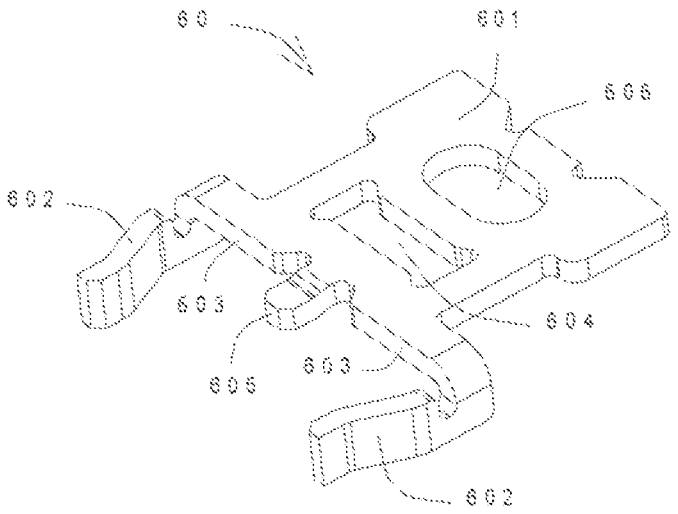
FIG. 8(A) is a perspective view of a locking member viewed from a fitting direction side.
Figure 8B:
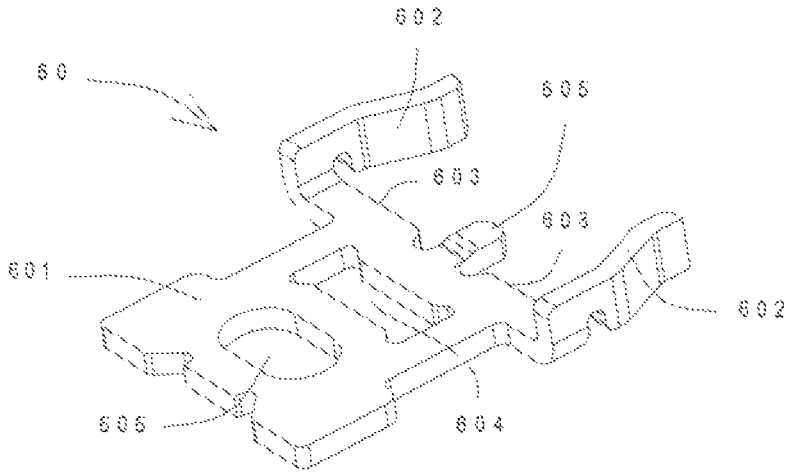
FIG. 8(B) is a perspective view of the locking member viewed from the side opposite to the fitting direction (side for connection to a substrate).

Next, the locking member 60 is described particularly with reference to FIGS. 2, 3 and 8. The locking member 60 is made of metal and is manufactured by pressing of a publicly known technique. Examples of the material of the locking member 60, which requires springiness, conductivity, and the like, can include beryllium copper, phosphor bronze, Corson alloy, and the like.

The locking member 60 has a substantially U shape and includes a locking piece 602 extending substantially in L shape from the operation portion 601 on both sides in the widthwise direction. The locking pieces 602 are inclined such that the locking pieces 602 facing in the widthwise direction have a narrower distance on an end side. The locking piece 602 is a portion that resiliently deforms the engagement portion 502 to spread the coupling wall 508, the extension wall 507, and the protrusion portion 501 outward in the widthwise direction such that the step portion 303 of the first fixture 30 of the plug connector 20 passes the guide portion 503 and enters an inner side of the engagement member 50 in the process of fitting the two connectors 20 and 40. Then, the locking member 60 releases the engagement portion 502 from the resiliently deformed state and, at the time of completion of fitting, the step portion 303 and the protrusion portion 501 of the engagement member 50 are brought into the lapped (engaged) state when viewed from the fitting direction. At the time of removal of the two connectors 20 and 40, when the operation portion 601 of the locking member 60 of the receptacle connector 40 is pushed inward in the longitudinal pitch direction, the locking piece 602 pushes and spreads the engagement portion 502 outward in the widthwise direction, and simultaneously the protrusion portion 501 is also spread outward in the widthwise direction. The locking piece 602 is also a portion that releases the lapped (engaged) state between the step portion 303 and the protrusion portion 501 of the engagement member 50 when viewed from the fitting direction. The size and the shape of the locking piece 602 are properly designed in consideration of the resiliency, the strength, the holding force, the workability, and the like.

In order to suppress movement of the locking member 60, the locking member 60 includes end surfaces 603 that face forward (pushing direction of the locking member 60) between the locking pieces 602 and are pressed against the housing 42 when the pushing operation of the locking member 60 is performed. The end surface 603 is to restrict movement of the locking member 60 at the time of fitting and removal of the two connectors 20 and 40. The size and the shape of the end surface 603 are properly designed in consideration of the strength, the workability, and the like.

The locking member 60 includes a locking hole 604 where the stopper piece 504 of the engagement member 50 enters. The locking hole 604 is to suppress movement of the locking member 60 in cooperation with the stopper piece 504 at the time of fitting and removal of the two connectors 20 and 40 with respect to each other. The size and the shape of the locking hole 604 are properly designed in consideration of the strength, the workability, and the like.

Here, a description is given of the manner of inserting the plug connector 20 with respect to the receptacle connector 40 and the manner of removal. First, the manner of insertion is described. When the two connectors 20 and 40 are fit with respect to each other, the step portion 303 of the first fixture 30 of the plug connector 20 enters an inner side of the engagement member 50 with use of the guide portion 503 of the engagement member 50 of the receptacle connector 40, the engagement portions 502 of the engagement member 50 spread outward in the widthwise direction by resiliency, and, at the time of completion of fitting, the step portion 303 and the protrusion portion 501 of the engagement member 50 are brought into the lapped (engaged) state when viewed from the fitting direction of the connectors 20 and 40.

Next, the manner of removal is described.

At the time of removal, the operation portion 601 of the locking member 60 of the receptacle connector 40 is pushed inward in the longitudinal pitch direction. Thus, the locking pieces 602 of the locking member 60 push and spread the engagement portions 502 of the engagement member 50 outward in the widthwise direction, and simultaneously the protrusion portions 501 are also spread outward in the widthwise direction. Thus, the aforementioned lapped state is released, enabling removal.

When the operation portion 601 is released again after removal, the engagement portion 502 pushes the locking piece 602 inward in the widthwise direction by resiliency, and the protrusion portions 501 are returned to the initial position corresponding to the position in which the protrusion portions 501 are lapped with the step portions 303 when viewed from the fitting direction at the time of fitting.

Moreover, in the present example, in order for the protrusion portions 501 of the engagement member 50 to more unfailingly return to the aforementioned initial position when the operation portion 601 of the locking member 60 is released, the locking member 60 includes a protrusion piece 605 that protrudes in a contact attachment direction as illustrated particularly in FIG. 8, and a coil spring 48 that engages the protrusion piece 605 is disposed as illustrated particularly in FIGS. 2 and 3. The protrusion piece 605 and the coil spring 48 assist the protrusion portions 501 of the engagement member 50 to return to the initial position. The shapes and the sizes of the protrusion piece 605 and the coil spring 48 are properly designed in consideration of the roles, the resiliency, the strength, the workability, and the like.

Moreover, in the present example, as illustrated particularly in FIG. 8, in order for the protrusion portions 501 of the engagement member 50 to be forcibly returned to the initial position by a jig {not illustrated) when the operation portion 601 of the locking member 60 is released, a hole 606 is formed in the operation portion 601 of the locking member 60. The hole 606, which receives the jig for forcibly returning the protrusion portions 501 of the engagement member 50 to the initial position, is not necessarily required, but is formed in consideration of safety. The shape and the size of the hole 606 are properly designed in consideration of the role, the strength, the workability, and the like.

Figure 6A:
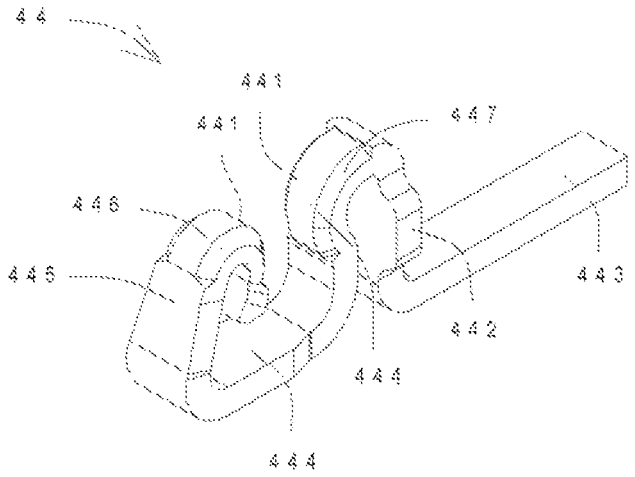
FIG. 6(A) is a perspective view of a receptacle contact viewed from a contact portion side.
Figure 6B:
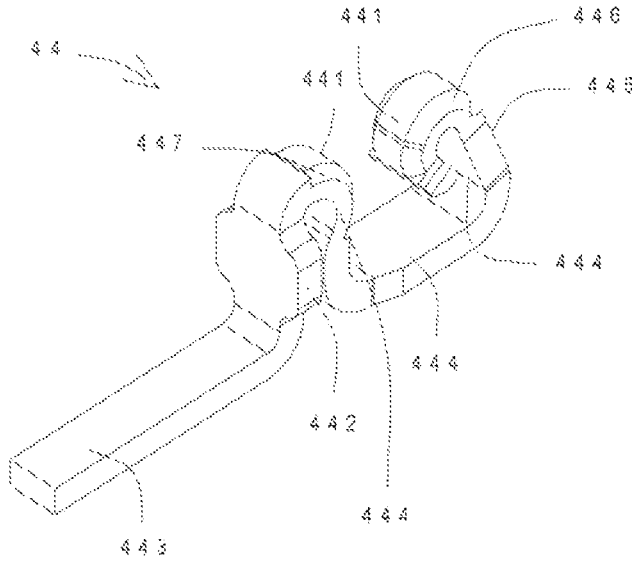
FIG. 6(B) is a perspective view of the receptacle contact viewed from the contact portion side.

Next, the receptacle contact 44 is described particularly with reference to FIG. 6. The receptacle contact 44 is made of metal and is manufactured by pressing of a publicly known technique. Examples of the material of the receptacle contact 44, which requires springiness, conductivity, and the like, can include beryllium copper, phosphor bronze, Corson alloy, and the like. The receptacle contact 44 includes a contact portion 441 that contacts the plug contact 24, which is a mating contact, a connection portion 443 connected to the substrate, and a resilient portion 444 that is curved at least once or more between the contact portion 441 and the connection portion 443. The contact portion 441, the resilient portion 444, and the connection portion 443 are disposed in this order. Furthermore, the receptacle contact 44 includes a fixation portion 442 that can also be a part of the resilient portion 444 on the connection portion 443 side, the fixation portion 442 being for holding on the housing 42. Moreover, in the illustrated example, two contact portions 441 are oppositely formed in the widthwise direction of the receptacle connector 40. A first chamfered portion 446 is formed on an upper surface side on one contact portion 441, and a second chamfered portion 447 is formed on an upper surface side on the other contact portion. Thus, the plug contact 24 is smoothly inserted between the contact portions 441 of the receptacle contact 44. An inclined portion 445 that is inclined toward the outer contact portion 441 (on the connection portion 443 side) is formed between the resilient portion 444 and the inner contact portion 441 of the receptacle contact 44.

The contact portion 441 is a portion that contacts the plug contact 24, and its shape is configured to provide surface contact in view of connection stability, and the contact portion 441 includes the first chamfered portion 446 so as to easily enter a recess 243 of the plug contact 24. The shapes and the sizes of the contact portion 441 and the first chamfered portion 446 are properly designed in consideration of such roles and connection stability, the workability, and the like.

The connection portion 443 is a portion mounted on the substrate. In the present example, the connection portion 443 is of a surface mount (SMT) type. The connection portion 443 may be of a DIP type or press-in type as long as it can be mounted on the substrate. The connection portion 443 is designed in consideration of the substrate occupation area, the mounting density, and the like.

The resilient portion 444 is a portion for ensuring resilient length and resilient force to obtain stable connection to the plug contact 24. Moreover, a part of the resilient portion 444 may also have the function of the contact portion 441. This part includes the second chamfered portion 447 to enable easy entry to the recess 243 of the plug contact 24. The shapes and the sizes of the resilient portion 444 and the second chamfered portion 447 are properly designed in consideration of such roles and connection stability, the workability, and the like. That is, the resilient portion 444 is also used as a second contact portion, and the first contact portion 441 and the resilient portion 444 (second contact portion 441) clamp the plug contact 24 to obtain stable connection.

The inclined portion 445 provided between the contact portion 441 and the resilient portion 444 is a portion that has substantially the same shape as an inclined portion 422 of an insertion hole 421 of the housing 42 to adjust backup so as to obtain stable connection. The shape and the size of the inclined portion 445 are properly designed to follow the inclined portion 422 of the housing 42 in consideration of such role and connection stability, the workability, and the like.

The fixation portion 442 is a portion fixed to the housing 42 and is fixed to the housing 42 by press-fitting, a catch (lance), welding, or the like. In the present example, it is fixed by press-fitting. The shape and the size of the fixation portion 442 are properly designed in consideration of the holding force, the strength, the workability, and the like.

Next, the housing 42 is described particularly with reference to FIG. 5. The housing 42 is electrically insulating plastic and is manufactured by injection molding of a publicly known technique. The material of the housing 42 is properly selected in consideration of the dimensional stability, the workability, the cost, and the like, and examples of the material can generally include polybutylene terephthalate (PBT), polyamide (66 PA, 46 PA), liquid crystal polymer (LCP), polycarbonate (PC), and a synthetic material thereof.

The housing 42 includes a fitting portion 14 that enters a first fitting port 12 of the plug connector 20, and a second fitting port 16 where the plug connector 20 enters. The fitting portion 14 and the second fitting port 16 may have any shape and size as long as the fitting portion 14 enters the first fitting port 12 and the plug connector 20 enters the second fitting port 16. That is, it is sufficient if the shapes and sizes match the shapes and sizes of the mating sides. The shapes and the sizes of the fitting portion 14 and the second fitting port 16 are properly designed in consideration of a reduction in size of the connector, the connection stability, the strength, the workability, and the like.

A required number of receptacle contacts 44 are attached to the housing 42, and two second fixtures 46 are held on the housing 42 (see, for example, FIG. 3). Therefore, the housing 42 includes insertion holes 421 in which the required number of receptacle contacts 44 are attached. The second fixtures 46, which are held by integral molding, do not need insertion holes or the like. That is, the second fixtures 46 are disposed in a mold as insert bodies, and then resin is poured to form the housing 42 around the second fixtures 46. When the resin is cured, the second fixtures 46 are in a state of being held on the housing 42. In FIG. 5, the drawing is made in a state where the second fixtures 46 are omitted for the sake of convenience of description. Therefore, the portions where the second fixtures 46 are supposed to be present are hollow. It is sufficient if the receptacle contacts 44 can enter the insertion holes 421, and the shape and the size of the insertion hole 421 are properly designed in consideration of the connection stability, the holding force, the strength, the workability, and the like.

Figure 5A:
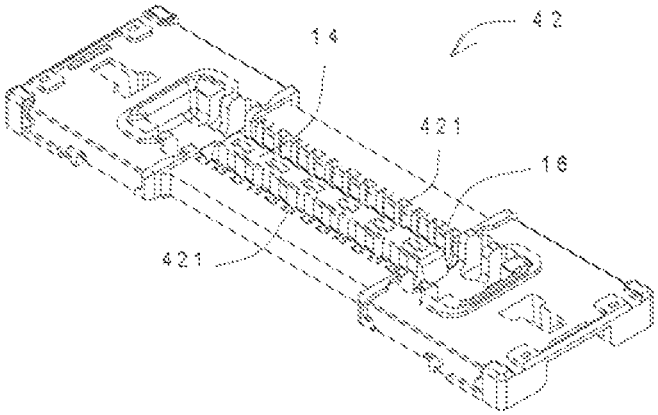
FIG. 5(A) is a perspective view of a housing viewed from a fitting direction.
Figure 5B:
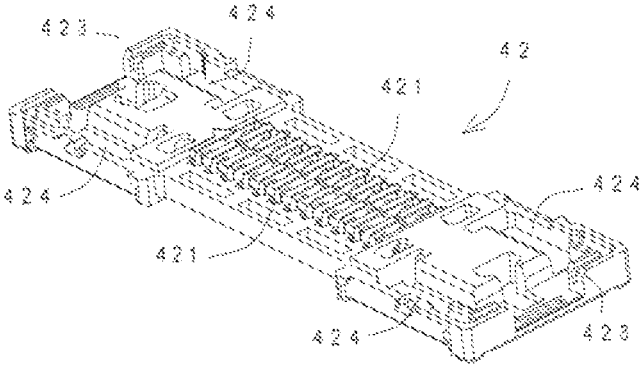
FIG. 5(B) is a perspective view of the housing viewed from the side opposite to the fitting direction (side for connection to a substrate).
Figure 5C:
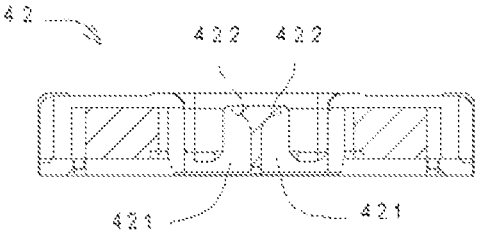
FIG. 5(C) is a cross-sectional view of the housing cut at a portion where a receptacle contact enters.
Figure 5D:
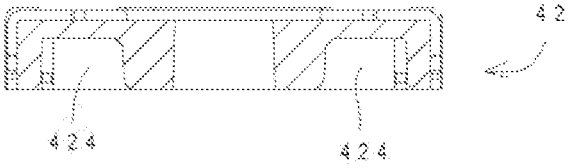
FIG. 5(D) is a cross-sectional view of the housing cut at a second fixture portion.

As illustrated in FIG. 5(B), the housing 42 includes insertion grooves 423 where the fixation portions 505 of the engagement members 50 enter. The fixation portions 505 are fixed to the insertion grooves 423 by press-fitting, a catch (lance), welding, or the like. In the present example, they are fixed by press-fitting. The shape and the size of the insertion groove 423 are properly designed in consideration of the holding force, the strength, the workability, and the like.

The housing 42 includes a space 424 having a substantially U shape that is opened on the substrate side and where the engagement member 50 and the locking member 60 enter. The locking member 60 can slide in the space 424. It is sufficient if the space 424 has a shape and size such that the engagement member 50 and the locking member 60 can enter and the locking member 60 can slide. The shape and the size of the space 424 are properly designed in consideration of the slidability, the strength, and the workability. Moreover, the locking member 60 is held by being sandwiched between the housing 42 and the engagement member 50 so as to be slidable.

In the present example, the second fixture 46 is held on the housing 42 by integral molding. The second fixture 46 including a fixation portion 466 is fixed to the housing 42 by integral molding. The housing 42 may use press-fitting or the like as long as the second fixture 46 can be held and fixed.

Figure 9A:
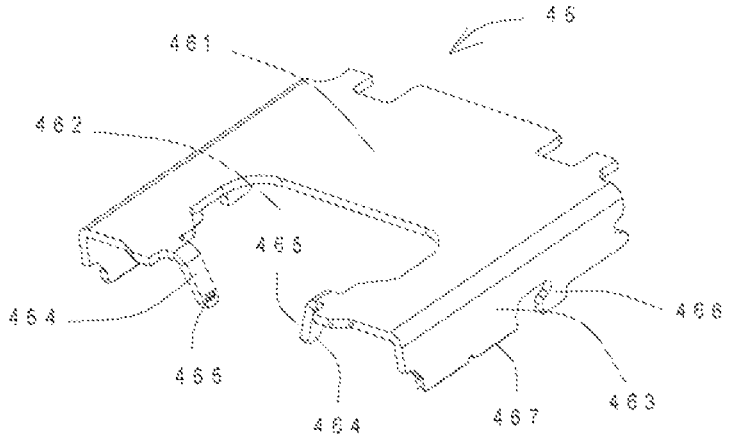
FIG. 9(A) is a perspective view of a second fixture viewed from a fitting direction.
Figure 9B:
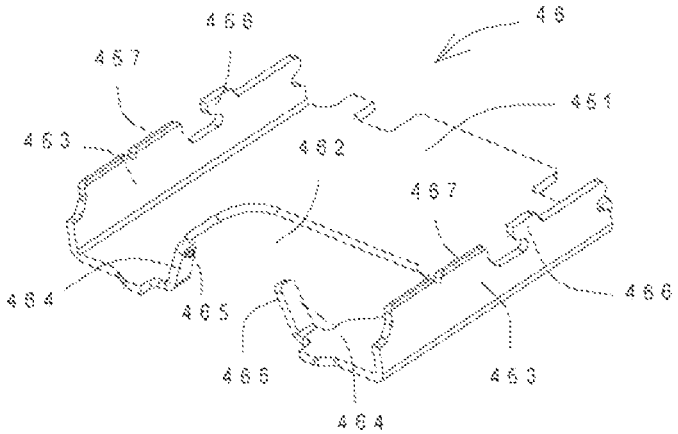
FIG. 9(B) is a perspective view of the second fixture viewed from the side opposite to the fitting direction.
Figure 10A:
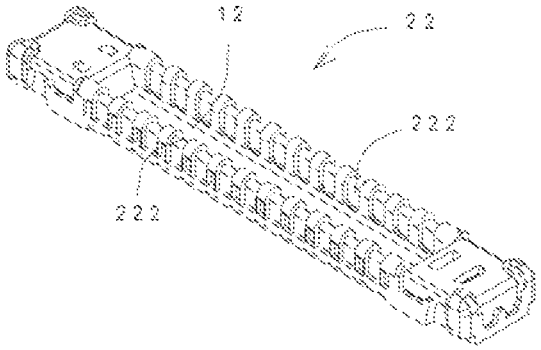
FIG. 10(A) is a perspective view of a block viewed from a fitting direction.
Figure 10B:
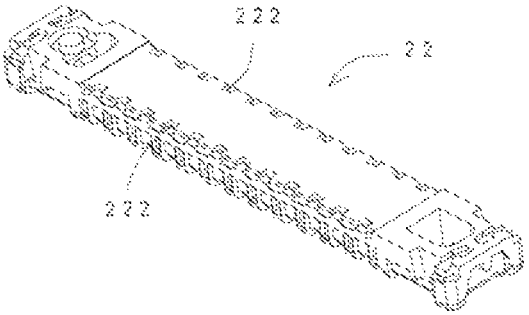
FIG. 10(B) is a perspective view of the block viewed from the side opposite to the fitting direction (side for connection to a substrate).
Figure 10C:
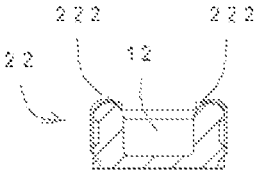
FIG. 10(C) is a cross-sectional view of the block cut at a portion where a plug contact enters.
Figure 10D:
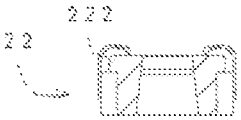
FIG. 10(D) is a cross-sectional view of the block cut at a fixture portion.

Next, the second fixture 46 is described particularly with reference to FIG. 9. The second fixture 46 is made of metal and is manufactured by pressing of a publicly known technique. Examples of the material of the second fixture 46, which requires springiness, moldability, and the like, can include beryllium copper, phosphor bronze, and the like.

The second fixture 46 includes a body 461 having a substantially U shape (cutout 462 on one side), two sidewalls 463 bent in the widthwise direction in a state of being held on the housing 42, and plate-shaped pieces 464 on one side (the cutout 462 side) of the two sidewalls 463. On a free end side of the plate-shaped piece 464, a contact portion 465 that contacts the first fixture 30 is provided. The two sidewalls 463 include the fixation portions 466 fixed to the housing 42, and connection portions 467 connected to the substrate.

The connection portion 467 is a portion mounted on the substrate. In the present example, it remains in a bent state, and is of a surface mount (SMT) type in consideration of the mounting density and the like of the connection portion 467, but may be of a DIP type.

In the present example, the second fixture 46 is held on the housing 42 by integral molding. The second fixture 46 including the fixation portion 466 is fixed to the housing 42 by integral molding. The second fixture 46 may be held and fixed by press-fitting or the like as long as it can be held and fixed to the housing 42.

The plate-shaped piece 464 including the contact portion 465 at an end has resiliency. Thus, when fitting to the plug connector 20, the plate-shaped piece 464 preferably contacts a contact wall 304 of the first fixture 30. Moreover, in the present example, the contact portion 465 has a protrusion shape. The shapes and the sizes of the plate-shaped piece 464 and the contact portion 465 are properly designed in consideration of the stable contact, the resiliency, the strength, the workability, and the like.

The components of the plug connector 20 are described on the basis of the drawings. The plug contact 24 is described particularly with reference to FIG. 11. The plug contact 24 is made of metal and is manufactured by pressing of a publicly known technique. Examples of the material of the plug contact 24, which requires springiness, conductivity, and the like, can include beryllium copper, phosphor bronze, Corson alloy, and the like.

Figure 11A:
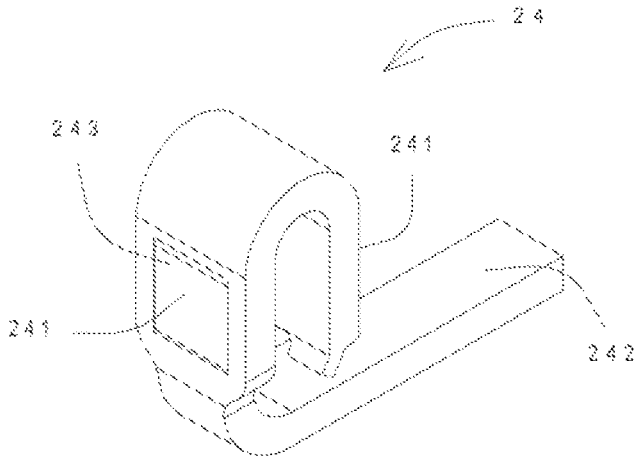
FIG. 11(A) is a perspective view of a plug contact viewed from a contact portion side.
Figure 11B:
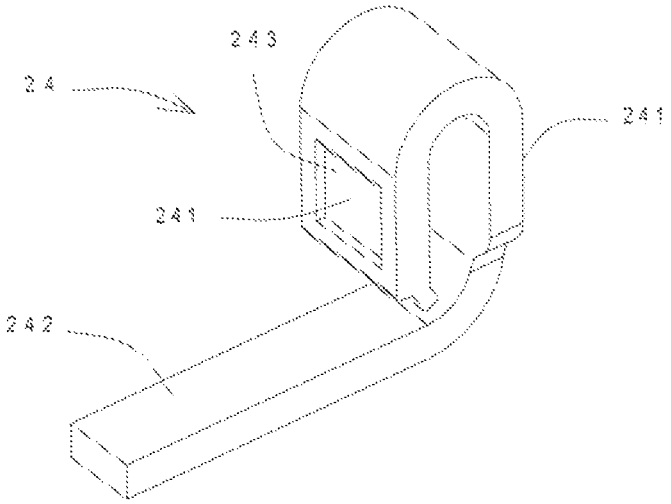
FIG. 11(B) is a perspective view of the plug contact viewed from the contact portion side.

In the present example, the plug contact 24 has a substantially L shape as illustrated in FIG. 11. The plug contact 24 at least includes a contact portion 241 that contacts the receptacle contact 44, which is a mating contact, and a connection portion 242 connected to the substrate. In the present example, the plug contact 24 is held on the block 22 by integral molding. That is, a required number of plug contacts 24 are disposed in a mold, and resin is poured to form the block 22 around the plug contact 24. When the resin is cured, the plug contact 24 is held on the block 22.

The contact portion 241 of the plug contact 24 includes the recess 243, which is shallow, where the receptacle contact 44 enters. When the first chamfered portion 446 of the receptacle contact 44 enters the recess 243, misalignment is prevented and click feeling and stable connection can be obtained. It is sufficient if the recess 243 has a shape and size such that the receptacle contact 44 can enter. The shape and the size of the recess 243 are properly designed to match the shape and the size of the receptacle contact 44 to obtain stable connection.

In the present example, the connection portion 242 is a portion mounted on the substrate and is of a surface mount (SMT) type. The connection portion 242 may be of a DIP type as long as it can be mounted on the substrate.

It is desirable that the plug contact 24 includes a further recess 243 on the opposite side (back surface) of the contact portion 241. The second chamfered portion 447 of the receptacle contact 44 enters this recess 243. Thus, the plug contact 24 is clamped between the first chamfered portion 446 and the second chamfered portion 447 of the receptacle contact 44, and misalignment is further prevented, and click feeling and stable connection can be obtained. It is sufficient if the further recess 243 has a shape and size such that the receptacle contact 44 can enter, and the shape and the size of the further recess 243 are properly designed to match the shape and the size of the receptacle contact 44 so as to obtain stable connection.

Next, the block 22 is described particularly with reference to FIG. 10. The block 22 is electrically insulating plastic and is manufactured by injection molding of a publicly known technique. The material of the block 22 is properly selected in consideration of the dimensional stability, the workability, the cost, and the like, and examples of the material can generally include polybutylene terephthalate (PBT), polyamide (66 PA, 46 PA), liquid crystal polymer (LCP), polycarbonate (PC), and a synthetic material thereof. The plug contact 24 and the first fixture 30 are held on the block 22.

The block 22 includes the first fitting port 12 where the fitting portion 14 of the receptacle connector 40 enters when fitting to the receptacle connector 40. It is sufficient if the fitting portion 14 can enter the first fitting port 12. That is, it is sufficient if the shape and the size match the fitting portion 14 and, the shape and the size are properly designed in consideration of the strength, the workability, the connection stability, and the like.

Moreover, the plug contacts 24 and the first fixtures 30 are fixed to the block 22 by integral molding (see, for example, FIG. 4). In other words, the plug contacts 24 and the first fixtures 30 are disposed in a mold as insert bodies, and resin is poured to form the block 22 around them. When the resin is cured, the plug contacts 24 and the first fixtures 30 are fixed to the block 22. Therefore, the block 22 does not need holes for inserting the plug contacts 24 and the first fixtures 30. In FIG. 10, the drawing is made in a state in which the plug contacts 24 and the first fixtures 30 are omitted for the sake of convenience of description. Therefore, the portions where they are supposed to be present are hollows 222. The first fixture 30 is fixed to both end portions of the block 22 in the longitudinal pitch direction by integral molding. In the present example, the plug contacts 24 and the first fixtures 30 are fixed to the block 22 by integral molding, but the method of inserting and holding the plug contacts 24 and the first fixtures 30 is not limited thereto, but is properly designed in consideration of the holding force, the strength, the workability, and the like.

Figure 12A:
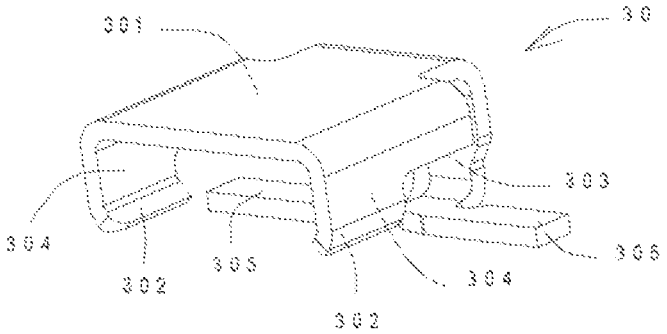
FIG. 12(A) is a perspective view of a first fixture viewed from a fitting direction.
Figure 12B:
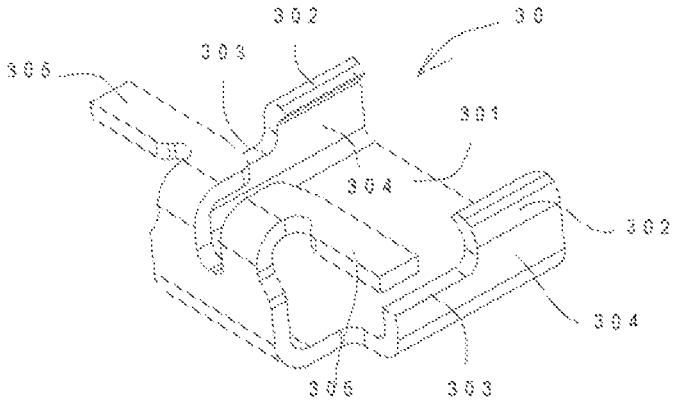
FIG. 12(B) is a perspective view of the first fixture viewed from the side opposite to the fitting direction (side for connection to a substrate).

Finally, the first fixture 30 is described particularly with reference to FIG. 12. The first fixture 30 is made of metal and is manufactured by pressing of a publicly known technique. Examples of the material of the first fixture 30, which requires springiness, moldability, and the like, can include beryllium copper, phosphor bronze, and the like.

The first fixture 30 at least includes a body 301, the contact walls 304 that are provided continuously from the body 301 and contact the second fixture 46, fixation pieces 302 that are provided continuously from the contact walls 304 in a width direction (widthwise direction) and embedded in the block 22, the step portions 303 that are formed on side surfaces and provided continuously from the contact walls 304 in the longitudinal pitch direction, and the connection portions 305 provided continuously on a rear end side of the body 301. The first fixture 30 is fixed to the block 22 by integral molding. In the present example, it is of a surface mount (SMT) type in consideration of the mounting density and the like of the connection portion 305, but may be of a DIP type.

The contact wall 304 is a portion that contacts the contact portion 465 of the second fixture 46. Therefore, the shape, the size, the thickness, and the like are properly designed in consideration of the contact stability.

The step portion 303 engages (contacts) the protrusion portion 501 of the engagement member 50 of the receptacle connector 40 to prevent unintended removal of the two connectors 20 and 40. The size and the shape of the step portion 303 are properly designed in consideration of the strength, the holding force, the workability, and the like.

Next, another embodiment of the receptacle connector 40 is described with reference to FIG. 13. Those similar to the elements or members described in the previous embodiment are designated the same reference numerals, and a redundant description will be omitted properly. As illustrated in FIG. 13(B), the receptacle connector 40 includes an overhang portion 426 overhanging toward the coupling wall 508 of the engagement member 50 on an inner wall of the housing that defines the space 424 for accommodating the engagement member 50 and the locking member 60. The overhang portion 426 extends in the widthwise direction of the receptacle connector 40. A small gap is formed between the overhang portion 426 and the coupling wall 508. However, the overhang portion 426 may be in contact with the coupling wall 508 in the aforementioned initial state.

In cases where such overhang portion 426 is provided, particularly when the step portion 303 of the plug connector 20 engages the protrusion portion 501 of the receptacle connector 40, it is possible to suppress rotation of the locking member 50 about the longitudinal direction of the receptacle connector 40 with the overhang portions 426. Thus, the step portion 303 can engage the protrusion portion 501 stably and smoothly.

Figure 13A:
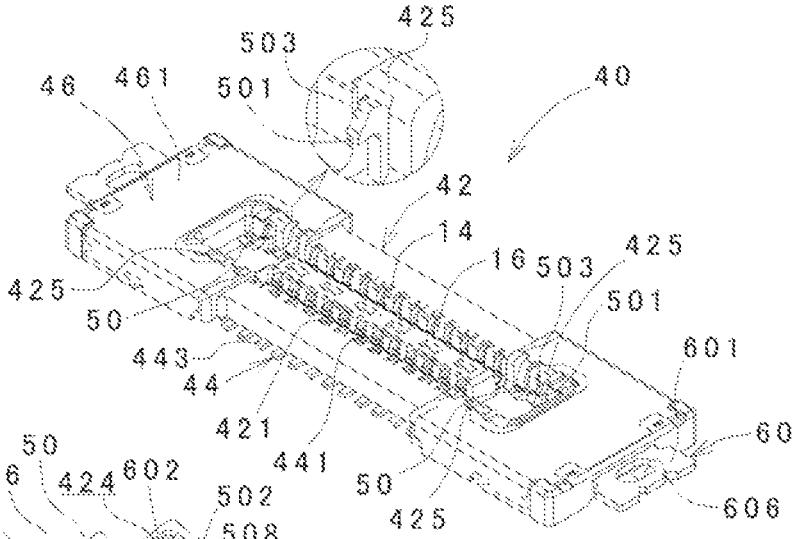
FIG. 13(A) is a perspective view of a receptacle connector according to another preferable example viewed from a fitting direction.
Figure 13B:
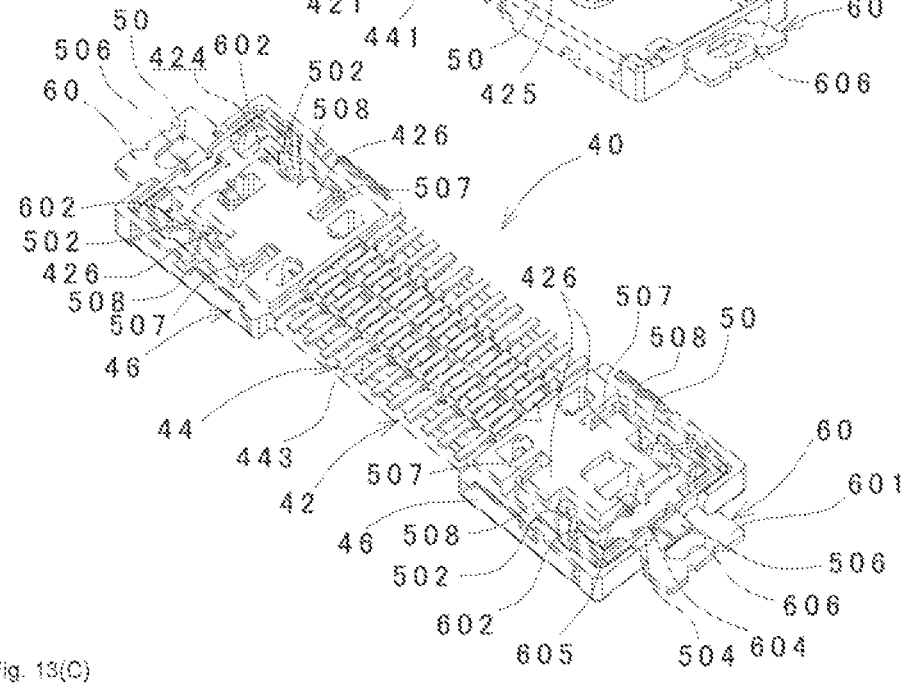
FIG. 13(B) is a perspective view of the receptacle connector viewed from the side opposite to the fitting direction (side for connection to a substrate).
Figure 13C:
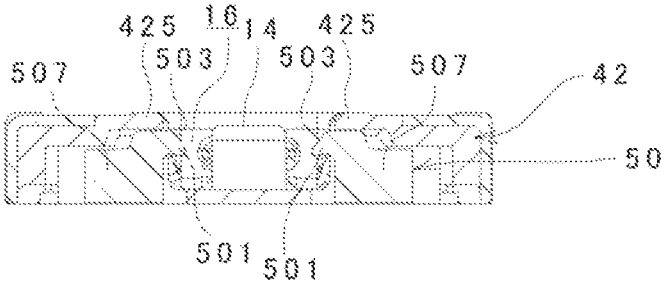
FIG. 13(C) is a widthwise cross-sectional view of the receptacle connector along a protrusion portion and a guide portion.

Moreover, in the present embodiment, as illustrated in FIGS. 13(A) and 13(C), the housing 42 includes a brim portion 425 that covers the extension wall 507 of the engagement member 50 on an upper side (insertion side of the plug connector 20). The brim portion 425 is extended in the widthwise direction to the position short of the protrusion portion 501 to expose the guide portion 503. It is preferable that the brim portion 425 be formed in proximity to the extension wall 507.

The brim portion 425 prevents the extension wall 507 from being lifted by the plug connector 20, for example, during removal of the plug connector 20, when, for example, disengagement between the step portion 303 and the protrusion portion 501 is insufficient. Thus, deformation or damage of the engagement member 50 can be prevented.

Figure 14A:
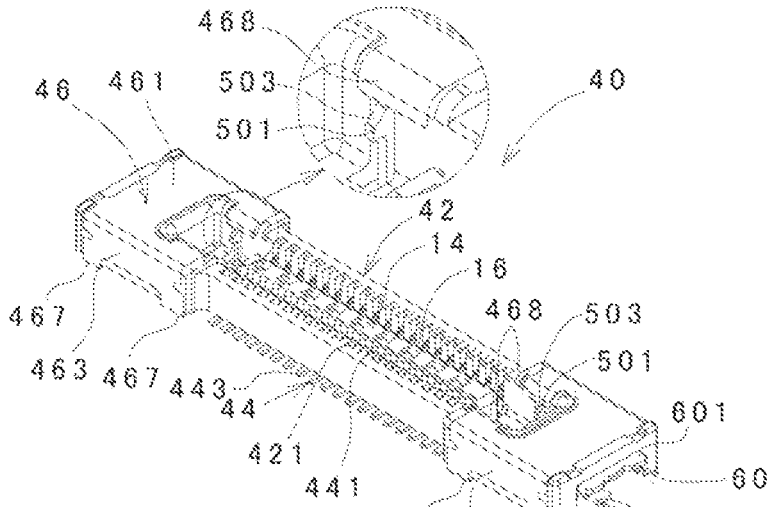
FIG. 14(A) is a perspective view of a receptacle connector of an electrical connector of another embodiment of the present invention viewed from a fitting direction.
Figure 14B:
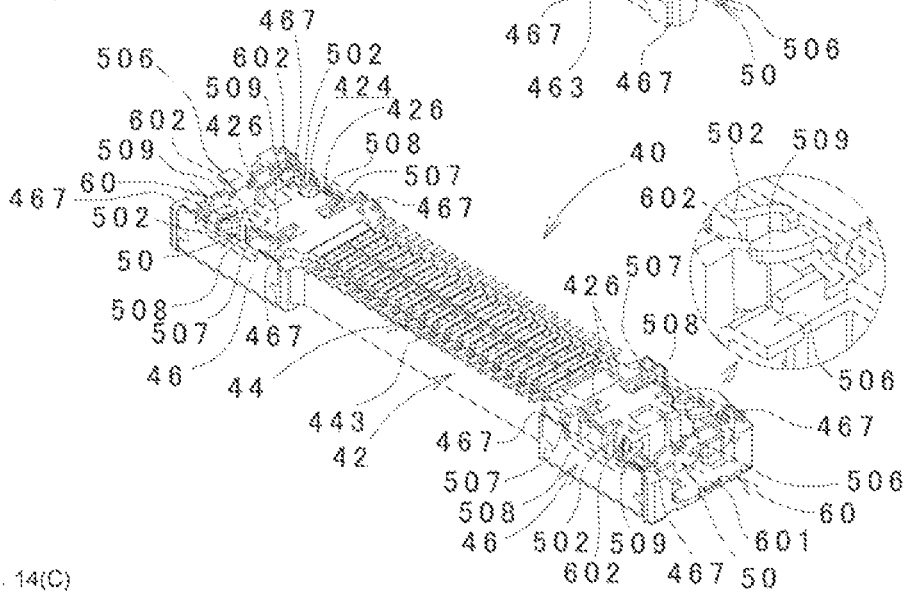
FIG. 14(B) is a perspective view of the receptacle connector viewed from the side opposite to the fitting direction (side for connection to a substrate).

FIG. 14 illustrates a yet another embodiment of the receptacle connector 40.

Those similar to the elements or members described in the previous embodiments are designated the same reference numerals and a redundant description will be omitted properly.

Figure 14C:
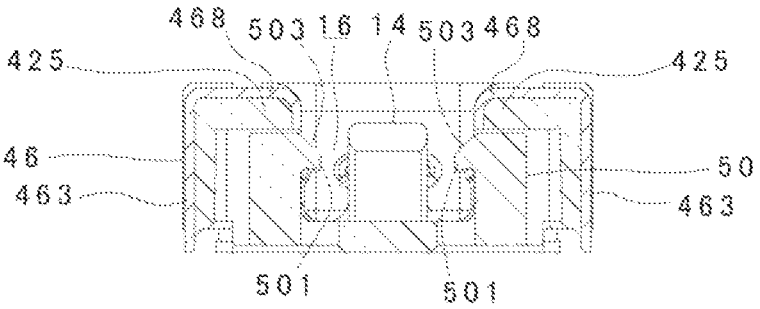
FIG. 14(C) is a widthwise cross-sectional view of the receptacle connector along a protrusion portion and a guide portion.
Figure 15A:
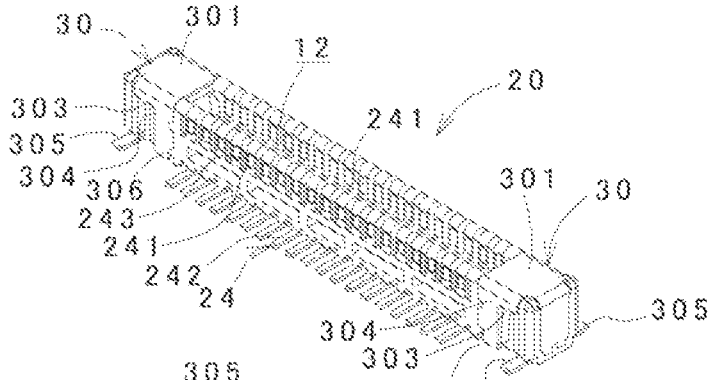
FIG. 15(A) is a perspective view of a plug connector suitable for fitting to the receptacle connector of FIG. 14 viewed from a fitting direction.
Figure 15B:
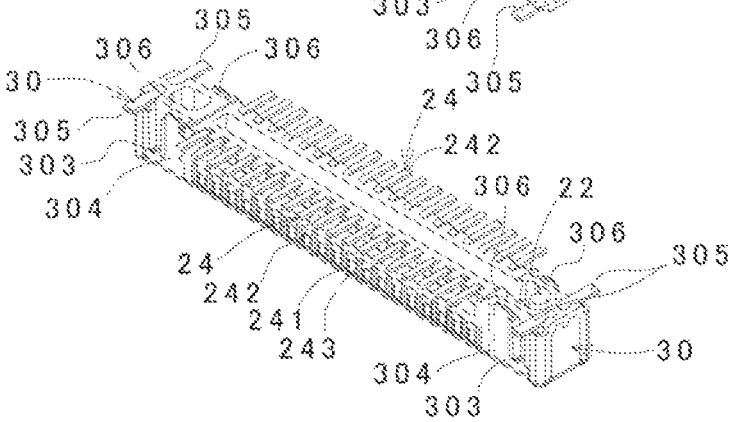
FIG. 15(B) is a perspective view of the plug connector viewed from the side opposite to the fitting direction (side for connection to a substrate).
Figure 15C:
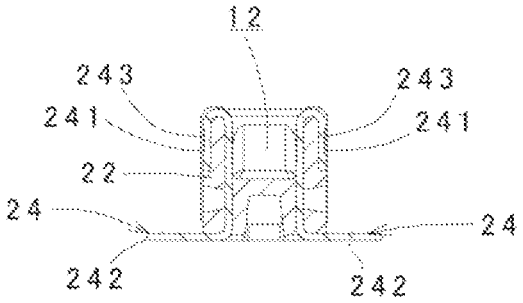
FIG. 15(C) is a widthwise cross-sectional view of the plug connector cut at a certain contact portion.
Figure 15D:
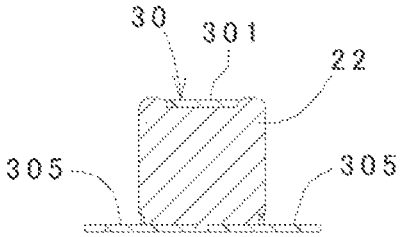
FIG. 15(D) is a cross-sectional view of the plug connector cut at a fixture portion.

In this embodiment, as illustrated in FIGS. 14(A) and 14(C), the second fixture 46 includes a cover wall 468 that covers an upper surface of the brim portion 425 in a close contact state. Thus, the brim portion 425 having the function described with reference to FIG. 13 is reinforced.

Moreover, in this embodiment, the engagement member 50 includes a projection piece 509 extending inward in the widthwise direction to cover the locking member 60. The projection piece 509 is to guide the slide movement of the locking member 60 in a height direction (fitting direction of the connectors 20 and 40) when the pushing operation of the operation portion 601 is performed. Thus, the locking member 60 can slide stably.

Furthermore, in this embodiment, the second fixture 46 includes two connection portions 467, which are separated in the longitudinal direction of the receptacle connector 40 on each side surface. The connection portions 467 can be soldered on the substrate. When the two connection portions 467 are thus provided separately in the longitudinal direction, the fixation stability and the holding strength between the second fixture 46 and the substrate are increased.

FIG. 15 illustrates another embodiment of the plug connector 20. Those similar to the elements or members described in the previous embodiments are designated the same reference numerals, and a redundant description will be omitted properly. In this plug connector 20, the first fixture 30 includes a fixation hanging piece 306 fixed to the substrate by soldering or the like instead of the fixation piece 302 that is embedded in the block 22. The fixation hanging piece 306 is extended from the contact wall 304 of the first fixture 30 downward to the height equal to that of the connection portion 305. Thus, when the fixation hanging piece 306 is provided in addition to the connection portion 305, the fixation stability and the holding strength between the first fixture 30 and the substrate are increased.

INDUSTRIAL APPLICABILITY

The present invention relates to a simple and reliable structure for attaching and detaching a plug connector and a receptacle connector that is used for an electrical connector used in a communication device, an electrical device, or an electronic device, e.g., a portable terminal or an audio device.

REFERENCE SIGNS LIST

10 electrical connector
12 first fitting port
14 fitting portion
16 second fitting port
20 plug connector
22 block
222 hollow
24 plug contact
241 contact portion
242 connection portion
243 recess
30 first fixture
301 body
302 fixation piece
303 step portion
304 contact wall
305 connection portion
306 fixation hanging piece
40 receptacle connector
42 housing
421 insertion hole
422 inclined portion
423 insertion groove
424 space
425 brim portion
426 overhang portion
44 receptacle contact
441 contact portion
442 fixation portion
443 connection portion
444 resilient portion
445 inclined portion
446 first chamfered portion
447 second chamfered portion
46 second fixture
461 body
462 cutout
463 sidewall
464 plate-shaped piece
465 contact portion
466 fixation portion
467 connection portion
468 cover wall
48 coil spring
50 engagement member
501 protrusion portion
502 engagement portion
503 guide portion
504 stopper piece
505 fixation portion
506 connection portion
507 extension wall
508 coupling wall
509 projection piece
60 locking member
601 operation portion
602 locking piece
603 end surface
604 locking hole
605 protrusion piece
606 hole

The invention claimed is:

1. An electrical connector comprising a plug connector and a receptacle connector configured to be attachable and detachable with respect to each other, characterized in that the plug connector includes a required number of plug contacts each including a contact portion that contacts a receptacle contact and a connection portion mounted on a substrate, and a block on which the plug contacts are held and arranged, the receptacle connector includes a required number of receptacle contacts each including a contact portion that contacts the plug contact and a connection portion mounted on a substrate, and a housing on which the receptacle contacts are held and arranged, a first fixture is disposed at both ends of the plug connector in a longitudinal pitch direction, the first fixture at least including a step portion and a connection portion spaced apart from the step portion, the connection portion being mounted on the substrate connected to the connection portion of the plug contacts, an engagement member having a substantially U shape including a protrusion portion on both free end sides is disposed at both ends of the receptacle connector in the longitudinal pitch direction, and includes an engagement portion that is bent on both sides in a widthwise direction and has resiliency, at a substantially intermediate portion of the engagement member, a locking member including a locking piece extending in a substantially L shape on both sides in the widthwise direction from an operation portion is disposed at both ends of the receptacle connector in the longitudinal pitch direction, and the locking pieces facing in the widthwise direction are inclined to have a narrower distance on an end side, in a process of fitting the plug connector and the receptacle connector, the step portion enters an inner side between the protrusion portions, the engagement portion is spread outward in the widthwise direction by resiliency, and, at a time of completion of fitting, the step portion and the protrusion portion are brought into a lapped state when viewed from a fitting direction, at a time of removal, when the operation portion is pushed inward in the longitudinal pitch direction, the locking piece pushes and spreads the engagement portion outward in the widthwise direction, and simultaneously the protrusion portion is also spread outward in the widthwise direction, and the lapped state is released, enabling removal, and when the operation portion is released, the locking piece is pushed inward in the widthwise direction at least by resiliency of the engagement portion, and the protrusion portion is returned to an initial position corresponding to a position in which the protrusion portion is lapped with the step portion when viewed from the fitting direction at the time of fitting.

2. The electrical connector according to claim 1, wherein the protrusion portion includes a guide portion on an insertion side of the plug connector.

3. The electrical connector according to claim 1, wherein an end surface of the locking member is pressed against the housing to suppress movement of the locking member.

4. The electrical connector according to claim 1, wherein a stopper piece is formed at a substantially middle portion of the engagement member to suppress movement of the locking member, and the locking member includes a locking hole where the stopper piece enters.

5. The electrical connector according to claim 1, wherein in order for the protrusion portion to return to the initial position when the operation portion is released, the locking member includes a protrusion piece that protrudes in a contact attachment direction, and a coil spring that engages the protrusion piece is disposed.

6. The electrical connector according to claim 5, wherein in order for the protrusion portion to be forcibly returned to the initial position by a jig when the operation portion is released, a hole is formed in the operation portion of the locking member.

7. The electrical connector according to claim 1, wherein the block includes a first fitting port where a fitting portion of the receptacle connector enters, and the housing includes a fitting portion that enters the first fitting port and a second fitting port where the plug connector enters, the plug contact is held on the block by integral molding and includes a recess where the receptacle contact enters, the receptacle contact includes a resilient portion that is curved at least once or more between the contact portion and the connection portion, the contact portion, the resilient portion, and the connection portion are disposed in an order of the contact portion, the resilient portion, and the connection portion, the receptacle contact further includes a fixation portion that is a part of the resilient portion on the connection portion side, the fixation portion being for holding on the housing, and an inclined portion that is inclined is formed between the resilient portion and the contact portion, the housing includes an insertion hole into which the receptacle contact is inserted, and the insertion hole is formed on an inclined portion having a curved shape, and the plug contact is clamped between the contact portion and the resilient portion of the receptacle contact to obtain stable connection.

8. The electrical connector according to claim 7, wherein the receptacle contact includes a first chamfered portion on the contact portion and a second chamfered portion on a part of the resilient portion on the fixation portion side, and the first chamfered portion of the receptacle contact engages the recess of the plug contact to provide click feeling as well as positioning and contact.

9. The electrical connector according to claim 1, wherein the receptacle connector further includes, at both ends in the longitudinal pitch direction, a second fixture that contacts the first fixture when the plug connector fits to the receptacle connector.

10. The electrical connector according to claim 9, wherein the engagement member includes an extension wall that extends m the widthwise direction and includes the protrusion portion at a free end, and the housing includes a brim portion that covers the extension wall on an insertion side of the plug connector.

11. The electrical connector according to claim 10, wherein the second fixture includes a cover wall that covers the brim portion.

* * * * *